US009017191B2

(12) United States Patent
Treto

(10) Patent No.: US 9,017,191 B2
(45) Date of Patent: Apr. 28, 2015

(54) MECHANICAL BROADHEADS WITH HINGED REAR BLADES

(71) Applicant: Timothy Lee Treto, Mead, WA (US)

(72) Inventor: Timothy Lee Treto, Mead, WA (US)

( * ) Notice: Subject to any disclaimer, the term of this patent is extended or adjusted under 35 U.S.C. 154(b) by 0 days.

(21) Appl. No.: 14/070,914

(22) Filed: Nov. 4, 2013

(65) Prior Publication Data

US 2014/0128186 A1 May 8, 2014

Related U.S. Application Data

(60) Provisional application No. 61/722,176, filed on Nov. 4, 2012.

(51) Int. Cl.
*F42B 6/08* (2006.01)

(52) U.S. Cl.
CPC ..... *F42B 6/08* (2013.01)

(58) Field of Classification Search
USPC ..... 473/583, 584
See application file for complete search history.

(56) References Cited

U.S. PATENT DOCUMENTS

| | | | | |
|---|---|---|---|---|
| 4,998,738 | A | 3/1991 | Puckett | |
| 6,669,586 | B2 | 12/2003 | Barrie et al. | |
| 6,830,523 | B1 | 12/2004 | Kuhn | |
| 6,910,979 | B2 | 6/2005 | Barrie et al. | |
| 6,935,976 | B1 | 8/2005 | Grace, Jr. et al. | |
| 7,713,151 | B2 | 5/2010 | Fulton | |
| 7,905,802 | B2 * | 3/2011 | Erhard | 473/583 |
| 8,007,382 | B1 * | 8/2011 | Sanford | 473/583 |
| 8,043,177 | B2 * | 10/2011 | Flanagan | 473/583 |
| 8,128,521 | B1 | 3/2012 | Ulmer | |
| 8,197,367 | B2 | 6/2012 | Pulkrabek et al. | |
| 8,449,415 | B2 | 5/2013 | Grace | |
| 8,545,349 | B1 * | 10/2013 | Budris et al. | 473/583 |
| 2009/0203477 | A1 * | 8/2009 | Mizek et al. | 473/583 |
| 2012/0165142 | A1 | 6/2012 | Grace | |
| 2014/0128185 | A1 | 5/2014 | Treto | |

* cited by examiner

*Primary Examiner* — John Ricci
(74) *Attorney, Agent, or Firm* — Lee & Hayes, PLLC

(57) ABSTRACT

A mechanical broadhead with a set of blades that mechanically activate via a fixed style blade that slides at impact. The blades may deploy inside a cavity of an animal or the blades may deploy outside a cavity of an animal. The blades are slideably secured in a body in accepting slots. The deployable blades may include a ratchet mechanism to lock the deployable blades in one or more positions. The mechanical broadhead maintains a low aerodynamic profile for proper flight via the deployable blades.

18 Claims, 10 Drawing Sheets

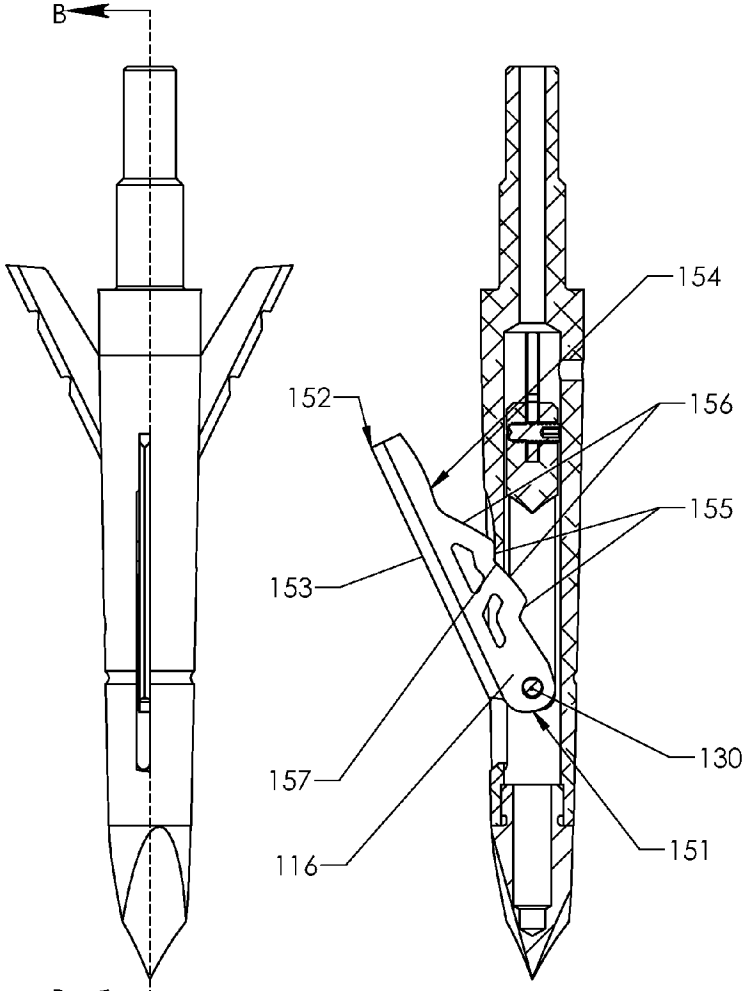
FIG. 2D
SECTION B-B
FIG. 2C
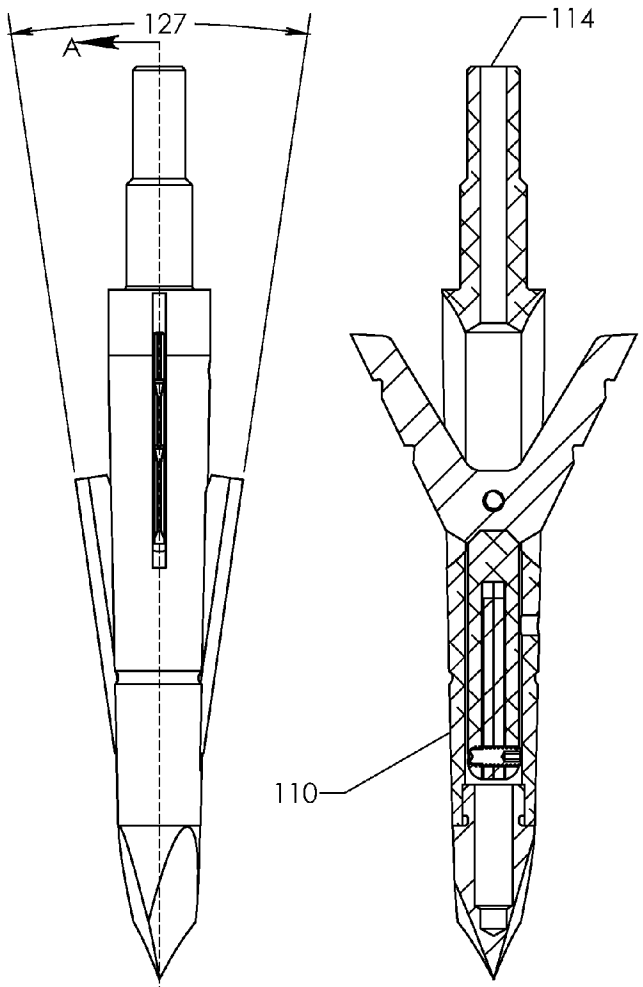
FIG. 2B
SECTION A-A
FIG. 2A 122
124
105
126
120
300
125
301

SECTION D-D

SECTION C-C 301
222
224
226
120
215

DETAIL E

MECHANICAL BROADHEADS WITH HINGED REAR BLADES

This application claims the benefit of U.S. Provisional Application No. 61/722,176 filed on Nov. 4, 2012, which is incorporated by reference herein in its entirety.

BACKGROUND

Broadhead designs exist to harvest an animal. Design features are employed to maximize a mechanical advantage for penetration and minimizing an aerodynamic profile for accurate shot placement. Existing mechanical broadheads may include expandable or deployable blades, fixed blades, or a combination of the two.

Mechanical broadheads are generally used in lieu of fixed blade broadheads to achieve straighter flight and greater cutting diameters.

BRIEF SUMMARY OF THE INVENTION

This brief summary is provided to introduce concepts of mechanical broadheads.

In one example, a mechanical and fixed style blade broadhead includes a fixed blade which slides and engages mechanical blades. There are two general approaches, one approach is to open on impact, and a second approach is to open inside the cavity. In an example, a fixed blade is arranged in front of rear blade and the rear blades are "pushed" open by the front fixed blade. In another example a front set of mechanical blades are deployed by a rear fixed blade. One advantage of opening in a cavity is that it allows the mechanical action to take place in the chest cavity and preserve energy for cutting to take place in the vital area rather than on bones. The trade-off is degree of entry wound.

Another key feature of the design is that the blades themselves may be pinned together and do not require fasteners or additional components such as rods or translatable rings. Because the blades may be pinned together, this minimizes part count resulting in lower manufacturing cost and ease of assembly. For example, existing mechanical blades typically utilize fasteners where the blade set is screwed in place. Further, existing heads may employ connecting rods or other additional translating ring components to connect blades together. In another example, the fixed blade and the mechanical blades may be pinned together.

In another example, one or more of the blades may include a ratcheting mechanism to allow for incremental opening. Traditional mechanical designs do not lock in place until fully deployed. For example, existing heads will utilize a "camming" profile, where the blade slides back and expands as it slides. In all these camming profiles there are only a single lock position. If it only deployed 50% of its capability, the blades would not lock and may return to the in-flight or stowed position. The present invention makes allowance for shots that do not hit perfect and blades maintain their deployed position even if they do not deploy 100%.

BRIEF DESCRIPTION OF THE DRAWINGS

FIG. 2A illustrates a top view of the mechanical broadhead in FIG. 1A.

FIG. 2B illustrates a section view of the mechanical broadhead of FIGS. 1A and 2A taken along line A-A illustrated in FIG. 2A.

FIG. 2C illustrates a side view of the mechanical broadhead in FIG. 1A.

FIG. 2D illustrates a section view of the mechanical broadhead of FIGS. 1 and 2C taken along line B-B illustrated in FIG. 2C.

FIG. 6A illustrates the blades in a closed or stowed position.

DETAILED DESCRIPTION

This disclosure is directed to mechanical broadheads for hunting. It is to be understood that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Existing mechanical broadheads typically contain two or more blades which deploy upon impact outside an animal, where the blades "self-deploy"—using its own geometry and inertia to deploy. Typically the broadhead blades will either pivot an acute angle "rear deployment" or a 180 degree angle "front deployment". Further they may incorporate a combined slide and pivot action to deploy. In yet another method a broadhead may utilize a tip to activate a rear or front deploying set of blades. Another design which focuses on preserving kinetic energy for cutting vital tissue is a method where the blades pivot 180 degrees around bone upon impact. While less resistance is encountered through bone, this pivoting of the blades through such a large angle may catch much resistance on tissue as it rotates around.

Figure 1A:
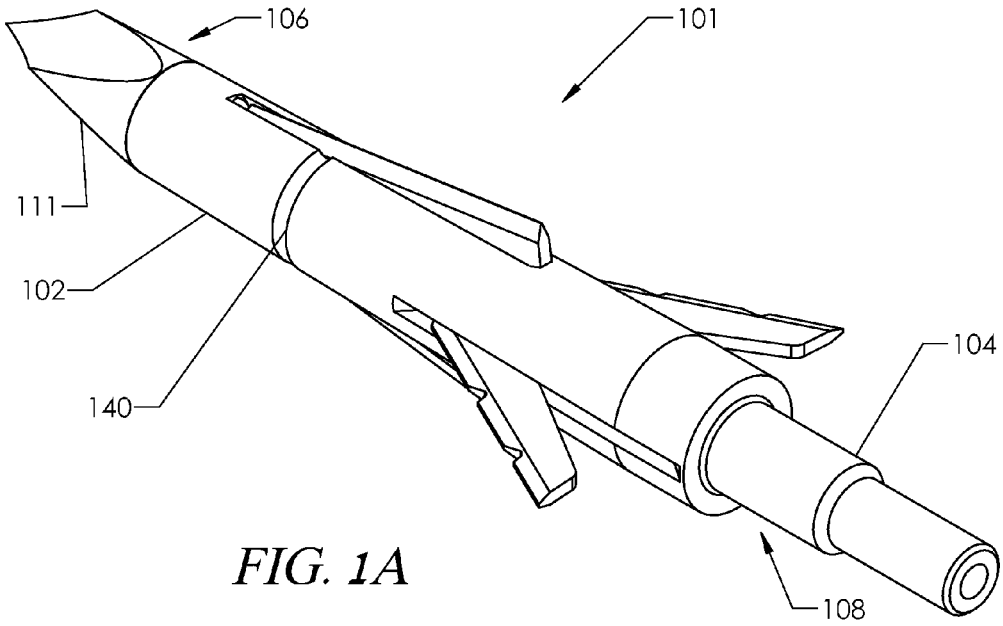
FIG. 1A illustrates a mechanical broadhead having blades that open inside a cavity of an organism in a closed or stowed position.
Figure 1B:
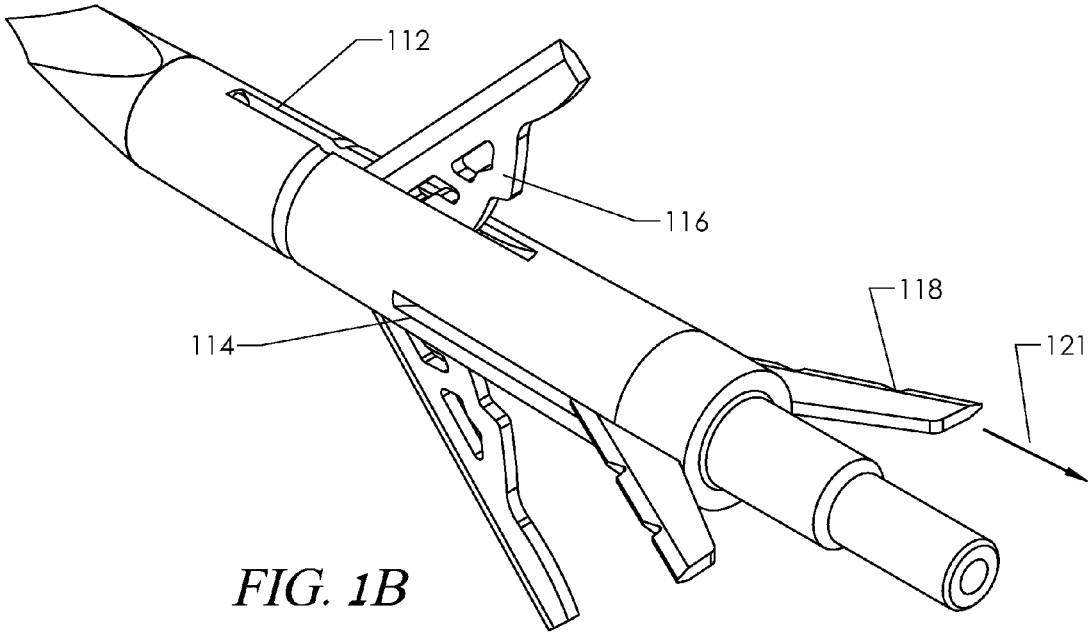
FIG. 1B illustrates the mechanical broadhead of FIG. 1A having the blades in an open or deployed position.

In any design which relies on the blade to "self-deploy" there is significant opportunity for deployment failure. If the blade doesn't catch correctly or is at a bad angle, the deploying mechanism may not work. Furthermore, the mechanical action of self-activating blades at impact can cause a significant amount of the momentum and kinetic energy to be lost. Regardless of design, deploying upon entry through bone and hide can cause significant energy usage. Unfortunately, as a result many times not enough energy remains for the arrow to travel deep into the vital organs or through the cavity and exit the opposing side entered. Design of blade deployment must be efficient to maximize energy for penetration while providing for a large entry wound for easier tracking of an animal. FIG. 1A illustrates a mechanical broadhead 101 in a closed position (e.g., in a flight or stowed position). For example, FIG. 1A illustrates the mechanical broadhead 101 having a hinged front blade and a fixed rear blade in a closed position during flight of an arrow the mechanical broadhead 101 may be attached to. FIG. 1B illustrates the mechanical broadhead 101 in an open position (e.g., deployed position). For example, FIG. 1B illustrates the mechanical broadhead 101 having a hinged blade and fixed rear blade in an open position after penetrating an animal.

The mechanical broadhead includes a body 102 that may be screwed to a stud 104. The body 102 may include a front end 106 opposite a backend 108. The body 102 and stud 104 may be one piece construction where the stud 104 and body 102 are combined to create a single component. The broadhead 101 may be assembled to a shaft 105 of an arrow when in used in archery. The body 102 may be solid in cross section. The body 102 may also be hollowed, bored, or contain other voids at various positions in cross section. The body 102 may contain a wall 110 extending in various sections between the front end 106 and back end 108. The body 102 may be tubular and may be round, square, polygonal or freeform (e.g., a closed section which may take any shape hourglass, curved, triangular, elliptical, or not otherwise geometric in shape with multiple curves) in cross-section. The body may contain a tip 111 which may be mechanically fastened or formed integral with the body. The body 102 may contain an aperture 112 passing through the wall 110 proximate to the front end 106. The body 102 may also contain an aperture 114 in the back end 108. The broadhead may contain a hinged blade 116 slideably disposed in the front aperture 112 and a fixed blade 118 slideably disposed in the rear aperture 114 wherein the fixed blade 118 is connected to the hinged blades 116. The apertures contain the blades and allow for sliding and pivoting. The distance between the fixed blade 118 and hinged blades 116 could be least 0.125 inches long and up to at most about 3 inches long. While FIG. 1B illustrates the hinged blade 116 and the fixed blade 118 as having two cutting blades, the hinged and fixed blades may have from about one cutting blade each or up to about six cutting blades each. The additional blades may be arranged around the outside of the body 102 in any manner, where the hinged blades are slideably disposed and connected to slideably disposed fixed blades.

Figures 3A, 3B, 3C:
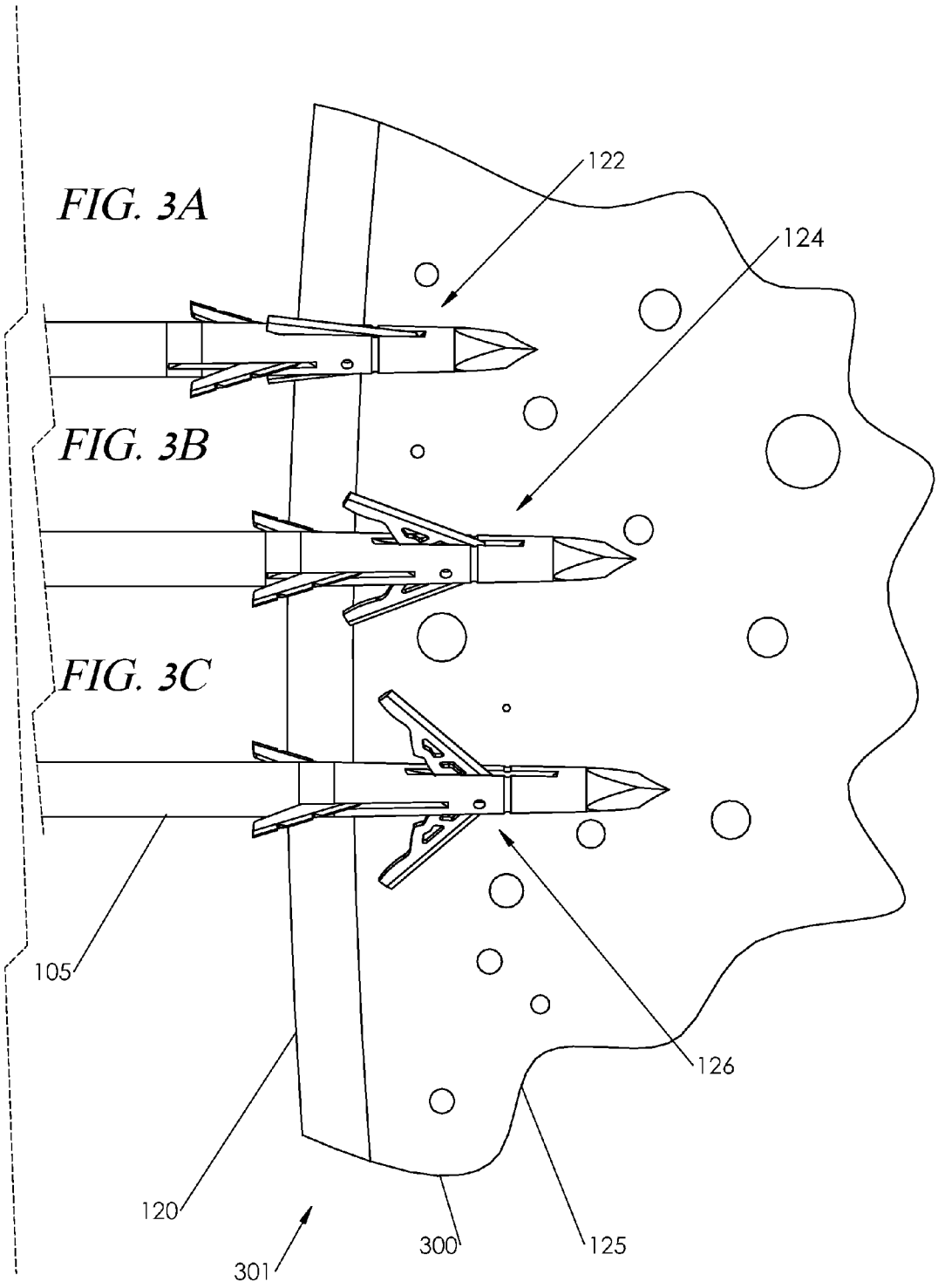
FIGS. 3A, 3B and 3C illustrate respective placements of the mechanical broadhead of FIG. 1A in a cut out section of an organism.

FIGS. 3A, 3B and 3C illustrate respective placements of the mechanical broadhead 101 of FIG. 1A in a cut out section 300 of an organism 301. FIGS. 3A-3C illustrates a sequence of deployment of the mechanical broadhead 101. FIG. 3A illustrates the front hinged blades 116 in a collapsed position to minimize a flight profile and a cutting profile until it enters the organism 301. FIG. 3B illustrates that as the fixed rear blade 118 hits the outer portion (e.g., a fur, a hide, bone, etc.) 120 of the organism 301, the fixed rear blade 118 slideably displaces rearward 121 from a first position in FIG. 3A to an intermediate position in FIG. 3B, then to a final position in FIG. 3C. During the sequence of deployment, the fixed blade 118 is connected to and therefore simultaneously displaces the hinged front blade 116 from a stowed position 122 in FIG. 3A where the hinged front blade 116 is adjacent to the body 102, to one or more intermediate positions 124, where the hinged front blade 116 is distal to the body 102 and inside a cavity 125. The deployed position 124 may be one or more intermediate positions 124 between the stowed position 122 and the deployed position 126. This slide and pivot action opens the hinged front blades 116 to a larger cutting diameter inside the cavity of the animal. For example, when in open position the diameter may be at least about 0.75 inches and up to at most about 3.5 inches.

The angle 127 between blades 116 may vary along the path of deployment. For example, when the first and second blades are in the stowed position 122, the first and second blades may have an angle 127 of at least about 0 degrees between the first and second blades 116. In this case, blades may be parallel to body 102. When in one or more intermediate positions of deployment, the blades 116 being distal to the body 102, the first and second blades 116 may have an angle 127 between the first and second blades 116 of at least about 1.25 times greater than an angle 127 between the first and second blades 116 when the first and second blades are in the stowed position 122. When the first and second blades 116 are in the maximum deployed position 126, the first and second blades 116 have an angle 127 of at most about 180 degrees between the first and second blades 116.

While the organism is described to be the mechanism by which the fixed blade 118 slides and deploys blades 116, the deployment could be provided by other means. For example, a spring-loaded mechanism triggered by impact of the fixed blade with the organism, which then pulls or pushes to deploy blades 116. For example, a spring (e.g., compression, tension or torsion) may be incorporated into the body 102 which may engage the blades in either a pulling or pushing fashion. The spring may be activated by a triggering mechanism that may be a protrusion which is slideably disposed or hinged to engage the organism or blades at impact.

Figure 4A:
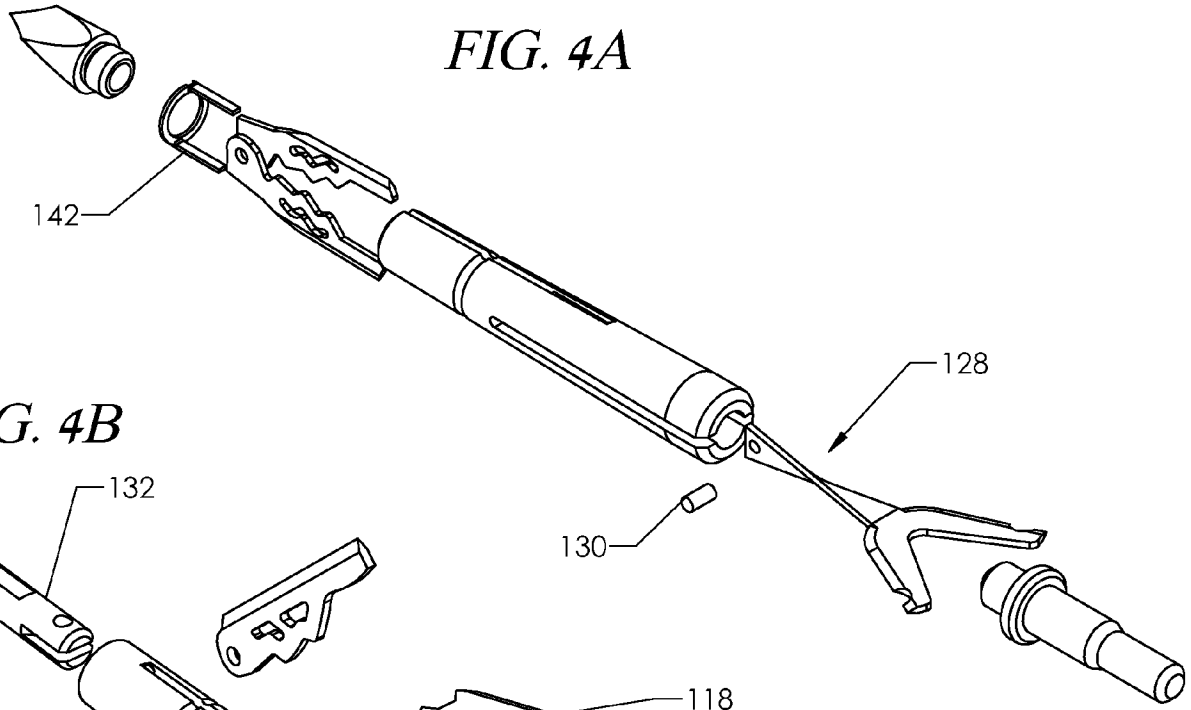
FIG. 4A illustrates an exploded view of a mechanical broadhead having blades that open inside a cavity of an organism.
Figure 4B:
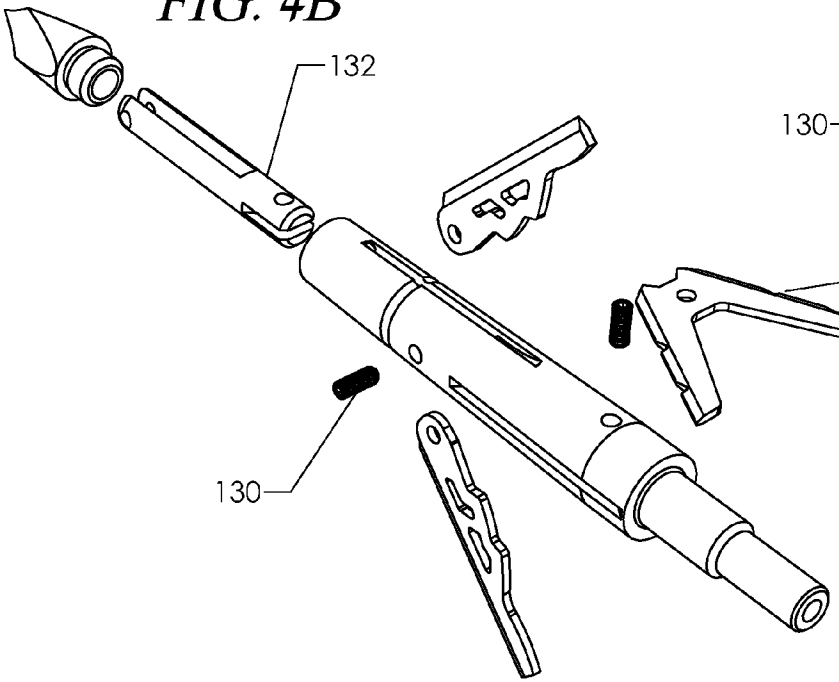
FIG. 4B illustrates an exploded view of the mechanical broadhead of FIG. 1A.
Figure 5A:
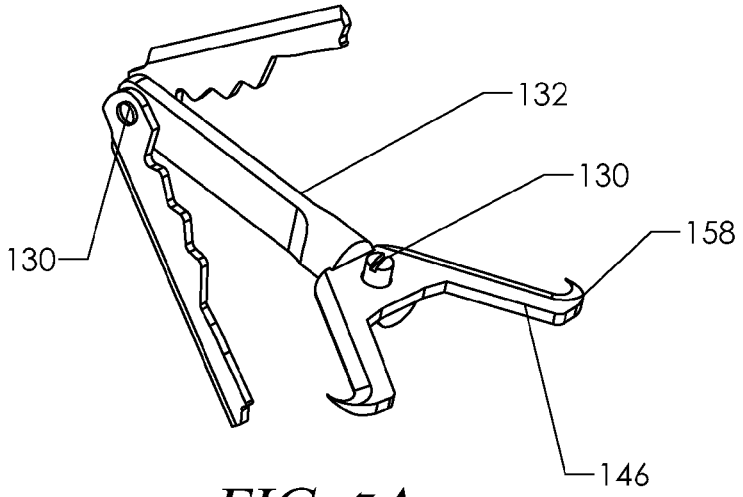
FIGS. 5A, 5B and 5C are respective isolated views of internal components of a mechanical broadhead having hinge blades that are linked to a fixed blade.
Figure 5B:
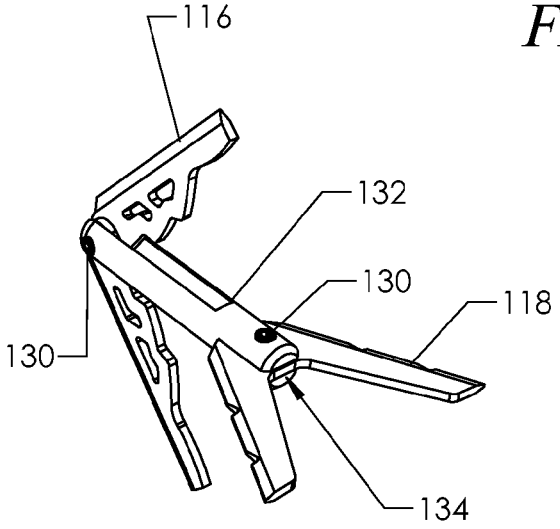
Figure 5C:
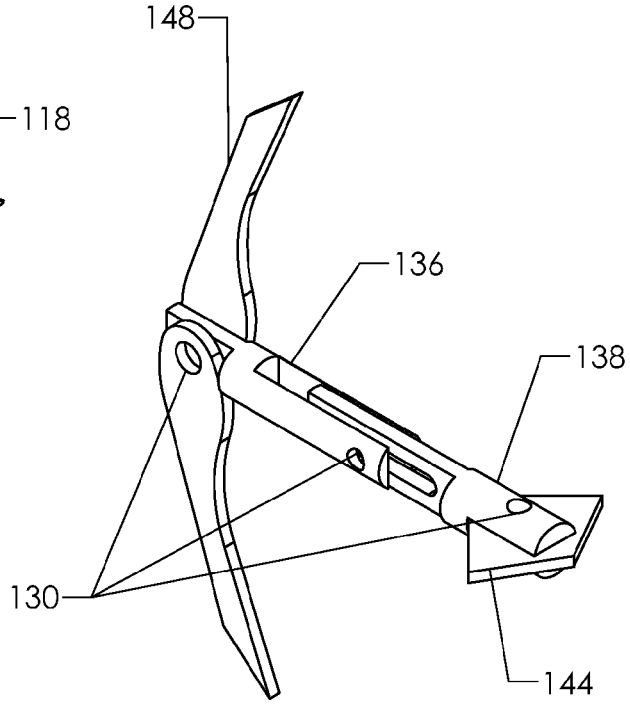

The rear blade 118 may be connected to the hinged blade 116 by a number of methods. For example, as illustrated in FIG. 4A the rear fixed blade 118 may comprise an elongated protrusion 128 integrally formed with the rear fixed blade 118. The elongated protrusion 128 may have a twisted elongated shape to provide for coupling to a hinge 130 of the front pair of hingeably connected blades 116. The coupling may be fastened by a pin or fastener 130. Further, as illustrated in FIGS. 4B, 5A and 5B a connecting rod 132 may be used to connect the front 116 blade with the rear blades 118. In this embodiment, the connecting rod 132 may be coupled with the hinge 130 of the front pair of hingeably connected blades 116 via a pin or fastener 130 and fastened to the fixed rear blade 118 with a pin or fastener 130. The fastener 130 could also be installed in the end 134 of the connecting rod 132 for a different method of assembly and fixed blade 118 restraint. Yet another example of connection is shown in FIG. 5C, where 2 connecting rods 136, 138 may slide front to back within the body 102 to allow the rear blade 118 to move rearward and delay deployment of hinged blades 116 for a prescribed or predetermined distance, for example 0.125" to 1.5".

The hinged blade set 116 may be contained from being deployed in flight by either an elastomeric o-ring 140 or spring retaining clip 142. Blades 116 may also be retained from deployment by inserting a rod, string or other material which provides a friction fit between the blade and the body aperture 112. The body 102 may also contain a protrusion or bump for containing the blades 116. Further, a sheath or wrapping which slides around the assembly may be utilized for blade 116 containment. In another method, blades may be retained by an adhesive between the blades 116, or the blades and body 102. Further, the fastener or pin 130 may provide a press fit or friction fit on the hinge 130 to restrain blades 116 from deploying. A magnet could also be installed to contain the blades.

The rear blade 118 may be many different shapes and profiles. For example, the rear blade 118 may be curved, straight, jagged etc. Further, the rear blade 118 may contain notches or serrated edges, for example. FIGS. 5A, 5B and 5C illustrate alternative shaped rear blades. The same would also apply to front blade set 116 where the cutting profile could be curved, straight or jagged etc., and may contain notches or serrated edges. FIGS. 5A, 5B and 5C illustrate alternative shaped front blade sets.

The mechanical broadhead 101 may be assembled as a complete unit or in sections. For example, the front and rear blades 116 and 118 may be assembled in the body 102. For example, the rear blade 118 may slide through body 102, then the front blade set 116 may be pinned to the rear blade 118. The stud 104 and tip 111 may then be screwed or pressed on the body 102. One skilled in the art would recognize the male and female threads could also be the inverse of what is shown in the figures. In another method, the blades may enter through apertures in the body, and be coupled together in the body without requiring removal or installation of a tip or stud, allowing for a tip or stud to be formed integrally with the body.

FIG. 2D shows the hinged blades 116 may include a nose 151 opposite a tail 152, and a cutting edge 153 opposite a spine 154, the cutting edge and the spine arranged between the nose and the tail, and wherein the nose of the first blade is hingeably coupled with the nose of the second blade. FIG. 2D illustrates a mechanism wherein the hinged front blade 116 is ratcheted to lock in one or more intermediate positions between the stowed position 122 and the deployed position 126. The multi-locking or ratcheting positions may be accomplished by a set of angled teeth 155 arranged along at least one of the spines 154 of the blades 116. During deployment, when the fixed blade 118 comes in contact with an exterior surface (e.g., a fur, a hide, etc.) and the rear blade 118 pulls the front blade 116 back such that surface 156 of the hinged blade 116 slides against surface or pawl or pocket 157 of the body 102 and thereby slides out and locks in position 124, 126 or another intermediate position where angled teeth 155 rest against a pocket 157 arranged in the body 102 in the front aperture 112. For example, if the blade 116 has an undesirable performance or problem in the shot that would deter deploying fully to position 126, then it would deploy to position 124 and lock. Moreover, the intermediate locking positions may have any combination of stepped increments of cutting diameters ranging from 0.5 inch to 3.5 inches. For example one combination of locking positions could be when blade 116 is locked in position 126 the cutting area or blade diameter could measure 2 inches, and in position 124 about 1.25 inches.

While three positions are described any number of positions are contemplated. For example, a cutting diameter stepped increment of 0.75", 1.375", and 1.75".

Further, while the ratchet mechanism is illustrated as comprising notches arranged in edges of the front blades and a pocket 157 arranged in the body 102 in the front aperture 112 of body 102, other ratchet mechanisms are contemplated. For example, additional pockets and/or pawls may be arranged in body 102 to provide added engagement with the teeth 155 to provide various locking positions. Further, spring loaded mechanisms may be used as a ratchet mechanism. For example, a spring loaded mechanisms as used in torque wrenches is contemplated.

Additionally, separate components may be added to allow an end user to choose the length of cut. For example a user may decide to allow the deployment to only reach one intermediate position as in 124 by method of a collar attached to the body, or by installing a pin or rod behind the rear fixed blade 118 to limit the amount of slideable displacement and thereby limit deployed cutting diameter.

FIG. 5A illustrates another feature of the invention, the breakaway tabs 158 on the rear blade 146. The tabs 158 are designed with a small cross section such that if they hit bone they will break if overloaded per design rather than catching and losing momentum; whereas if they hit animal hide rather than bone, they will catch during penetration and open the front blade set 116.

The mechanical broadhead 101 may have ribs employed on the body 102 for strength and additional cutting edges.

Figure 6A:
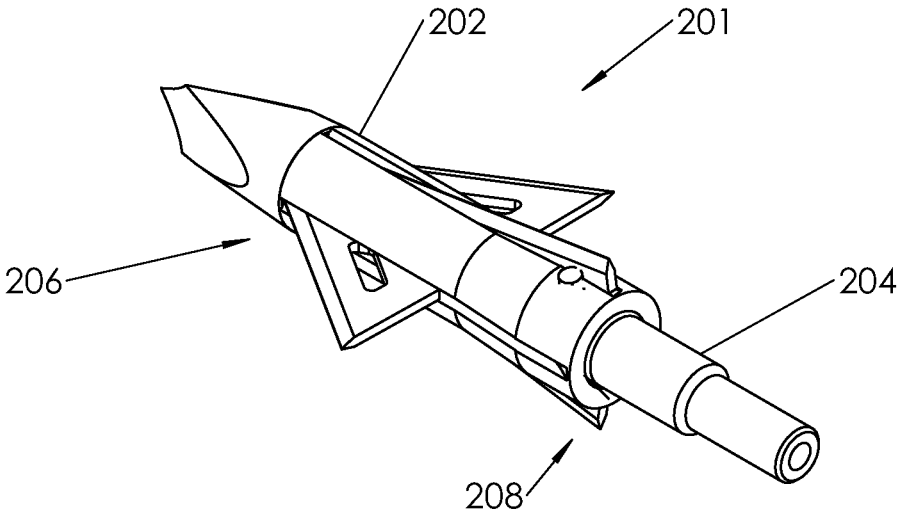
FIG. 6A illustrates a mechanical broadhead having blades that open before penetrating (e.g., outside a cavity) of an organism.
Figure 6B:
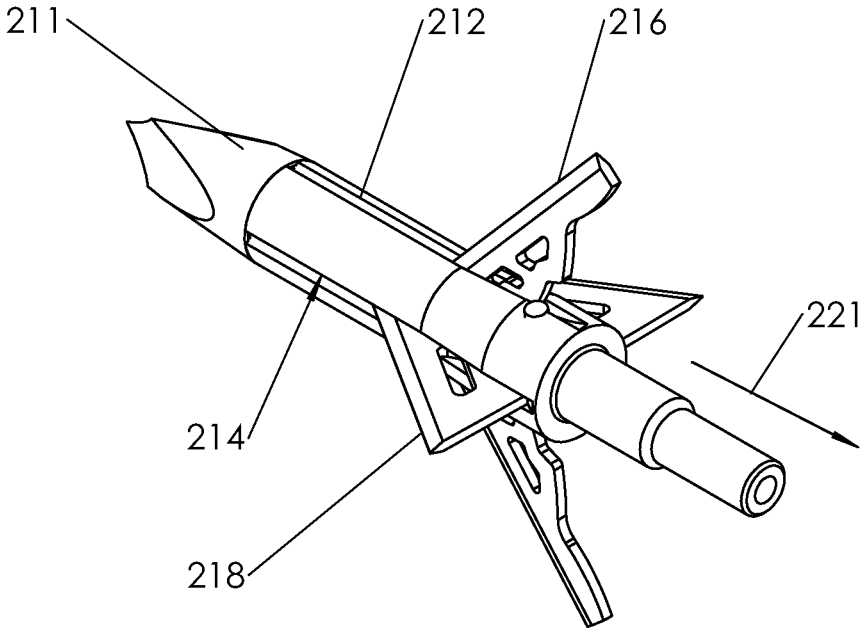
FIG. 6B illustrates the mechanical broadhead of FIG. 6A having the blades in an open or deployed position.

FIG. 6A illustrates a mechanical broadhead 201 in a closed position (e.g., in a flight or stowed position). For example, FIG. 6A illustrates the mechanical broadhead 201 having a fixed front blade and a hinged rear blade in a closed position during flight of an arrow the mechanical broadhead 201 may be attached to. FIG. 6B illustrates the mechanical broadhead 201 in an open position (e.g., deployed position). For example, FIG. 6B illustrates the mechanical broadhead 201 having a hinged blade and fixed front blade in an open position after impact with an animal (e.g., just prior to penetrating the animal).

The mechanical broadhead 201 includes a body 202 that may be screwed to a stud 204. The body 202 may include a front end 206 opposite a backend 208. The body 202 and stud 204 may be one piece construction where the stud 104 and body 102 are combined to create a single component. The broadhead 201 may be assembled to a shaft 105 of an arrow when used in archery. The body 202 may be solid in cross section. The body 202 may also be hollowed, bored, or contain other voids at various positions in cross section and therefore contain a wall 210 extending in various sections between the front end 106 and back end 108. The body 202 profile may be round, square, polygonal or freeform (e.g., a closed section which may take any shape hourglass, curved, triangular, elliptical, or not otherwise geometric in shape with multiple curves) in cross-section. The body 202 may contain a tip 211 which may be mechanically fastened or formed integral with the body. The body 202 may contain a first aperture 212 and second aperture 214 passing through the wall 210 between the front end of the body 206 and the back end of the body 208. The broadhead may contain a hinged blade 216 slideably disposed in the first aperture 212 and a fixed blade 218 slideably disposed in the second aperture 214 wherein the fixed blade 218 is connected to the hinged blades 216. The first and second apertures 212 and 214 may comprise slots and may contain the blades and allow for sliding and pivoting. The first and second apertures 212 and 214 may be arranged perpendicular relative to each other. Further, the first and second apertures 212 and 214 may be arranged at any angle relative to each other. The distance between the fixed blade 218 and hinged blades 216 could be least 0.125 inches long and up to at most about 3 inches long. While FIG. 6B illustrates the hinged blade 216 and the fixed blade 218 as having two cutting blades, the hinged and fixed blades may have from about one cutting blade each or up to about six cutting blade six cutting blades each. The additional blades may be arranged around the outside of the body 202 in any manner, where the hinged blades are slideably disposed and connected to slideably disposed fixed blades.

Figures 8A, 8B, 8C:
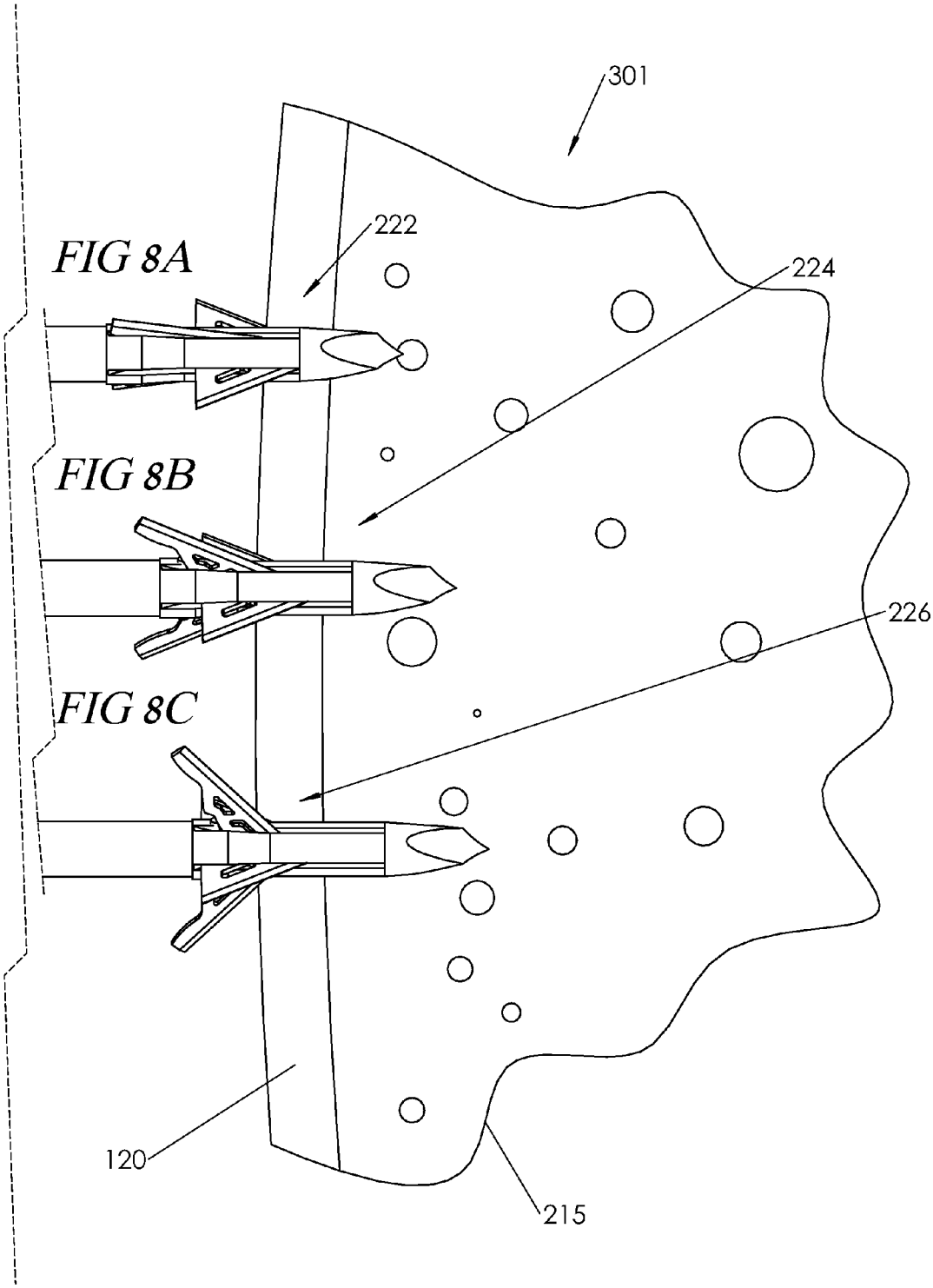
FIGS. 8A, 8B and 8C illustrate respective placements of the mechanical broadhead of FIG. 6A in a cut out section of an organism.

FIGS. 8A, 8B and 8C illustrate respective placements of the mechanical broadhead 201 of FIG. 6A in a cut out section 215 of an organism 301. FIGS. 8A-8C illustrate a sequence of deployment of the mechanical broadhead 201. FIG. 8A illustrates the rear hinged blades 216 in a collapsed position to minimize a flight profile and a cutting profile until it impacts the organism 301. FIG. 8B illustrates that as the fixed front blade 218 interfaces or interferes with the outer portion (e.g., a fur, a hide, bone, etc.) 120 of the organism 301, the fixed blade 218 slideably displaces rearward 221 from a first position in FIG. 8A to an intermediate position 224 in FIG. 8B, then to a final position 226 in FIG. 8C. During the sequence of deployment, the fixed blade 218 is connected to and therefore simultaneously displaces the hinged rear blade 216 from a stowed position 222 in FIG. 8A where the hinged rear blade 216 is adjacent to the body 202, to one or more intermediate positions 224 where the hinged rear blade 216 is distal to the body 202 and outside or transitioning into the organism. The deployed position 226, could be one or more intermediate positions 224 between the stowed position 222 and the deployed position 226. The slide and pivot action opens the hinged blades 216 to a larger cutting diameter outside and as it transitions into the cavity of the organism. For example, when in open position the diameter may be at least about 0.75 inches and up to at most about 3.5 inches.

The angle 227 between blades 216 may vary along the path of deployment. For example, when the first and second blades are in the stowed position 222, the first and second blades may have an angle 227 of at least about 0 degrees between the first and second blades 216. In this case blades may be parallel to body 202. When in one or more intermediate positions of deployment, the blades 216 being distal to the body 202, the first and second blades 216 may have an angle 227 between the first and second blades 216 of at least about 1.25 times greater than an angle 227 between the first and second blades 216 when the first and second blades are in the stowed position 222. When the first and second blades 216 are in the maximum deployed position 226, the first and second blades 216 have an angle 227 of at most about 180 degrees between the first and second blades 216.

While the organism is described to be the mechanism by which the fixed blade 218 slides and deploys blades 216, the deployment could be provided by other means. For example, a spring-loaded mechanism triggered by impact of the fixed blade with the organism, which then pulls or pushes to deploy blades 216. For example, a spring (e.g., compression, tension or torsion) may be incorporated into the body 202 which may engage the blades in either a pulling or pushing fashion. The spring may be activated by a triggering mechanism that may be a protrusion which is slideably disposed or hinged to engage the organism or blades at impact.

The front blade 218 may be connected to the hinged blade 216 by a number of methods to provide a slideably disposed and coupled assembly 228. For example, the front fixed blade 218 may comprise an elongated protrusion integrally formed with the front fixed blade 218. The elongated protrusion may have a twisted elongated shape to provide for coupling to a hinge 229 of the rear pair of hingeably connected blades 216. The coupling may be fastened by a pin or fastener 230. Further, a connecting rod may be used to connect the front blade 216 with the rear blades 218. In this embodiment, the connecting rod may be coupled with the hinge 229 of the pair of hingeably connected blades 216 via a pin or fastener 230 and fastened to the fixed front blade 218 with a pin or fastener 230. Yet another example of connection is contemplated where 2 connecting rods may be slideably disposed and connected together to slide front to back within the body 202 to allow the front blade 218 to move rearward and delay deployment of hinged blades 216 for a prescribed or predetermined distance, for example 0.125" to 1.5".

Figure 9A:
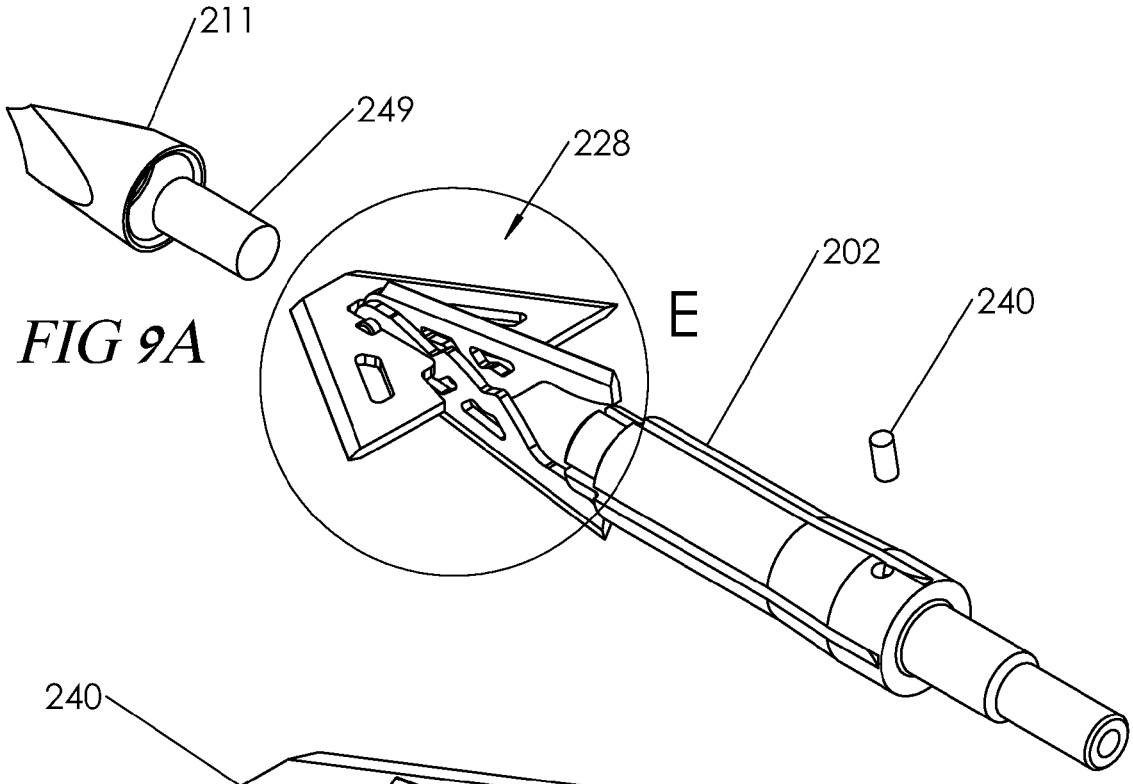
FIG. 9A illustrates an exploded view of the mechanical broadhead of FIG. 6A.
Figure 9B:
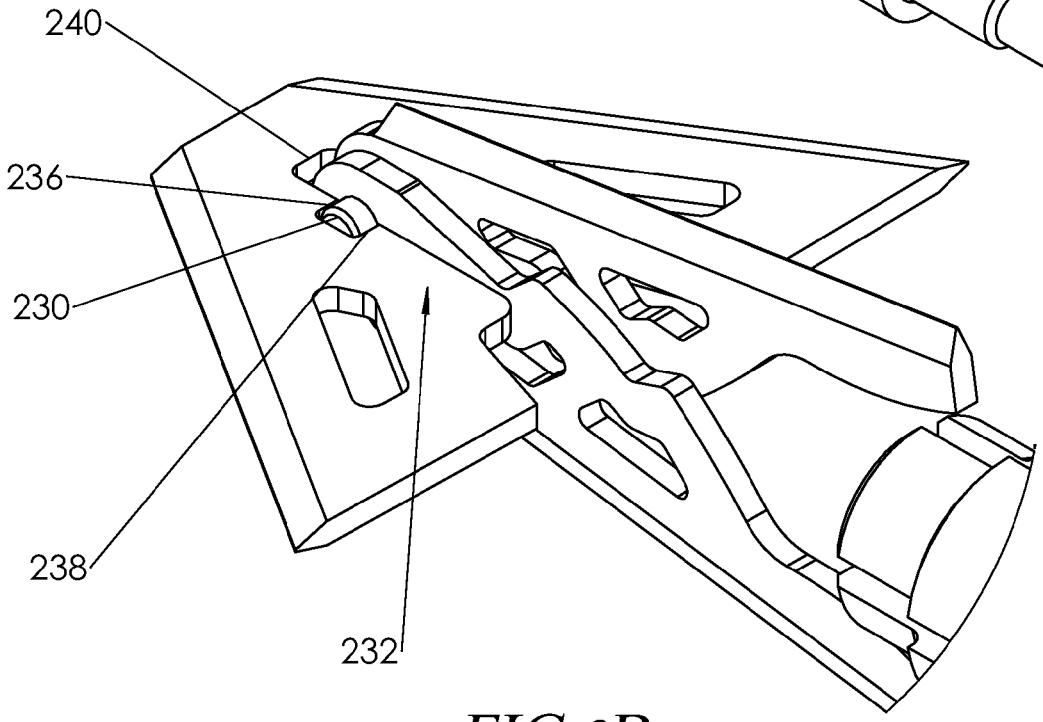
FIG. 9B is a detail view of the blade assembly of mechanical broadhead of FIG. 9A taken about section E in FIG. 9A.

FIGS. 9A and 9B illustrate another method of coupling a blade assembly 228 together. FIGS. 9A and 9B show the hinged blade 216 set may be pinned together, then captured or placed in a cooperating notch 232 in the fixed blade 218. The notch 232 in the fixed blade 218 may contain geometry that acts upon the pin 230 and allow slideable displacement of the blade assembly 228. For example, pin 230 may protrude normal to the hinged blade 216 and engage surfaces 236 and 238 which may push and pull on the pin 230 and therefore slideably dispose the assembly. The notch 228 may also act upon the hinged blades 216 and not the pin 230, and allow for slideable displacement of the blade assembly 234. For example if the pin 230 did not protrude beyond blades 216, the notch 228 may engage blades 216 and slideably disposed the assembly.

The blade coupling may also be provided without need of fasteners or pins. For example, the blades may contain protrusions which hingeably couple the fixed blade to the hinged blades. For example tabs may be formed or machined in one or more of the components to create the deployment action.

The hinged blade set 216 may be contained from being deployed in flight by either an elastomeric o-ring or a spring retaining clip. Blades 216 may also be retained from deployment by inserting a rod, string or other material which provides a friction fit between the blade and the body aperture 212. The body 202 may also contain a protrusion or bump for containing the blades 216. Further, a sheath or wrapping which slides around the assembly may be utilized for blade 216 containment. In another method, blades may be retained by an adhesive between the blades 216, or the blades and body 202. Further, the fastener or pin 230 may provide a press fit or friction fit on the hinge 229 to restrain blades 216 from deploying. A magnet could also be installed to contain the blades. In yet another method, a device can be installed to act as a wedge to hold blades in place. For example a pin 240 may be installed in body 202 to provide a friction surface between the blade 216, pin 240 and body 202. The pin 240 may be installed orthogonal to the blade 216 or may be installed at an angle. The angle may provide a lead-in for the blade to follow during installation. The pin 240 may contain various shapes to restrain the blade, for example round, rectangular, ribbed, knurled etc. Further the blade 216 may contain features to create additional restraint for blades during flight. For example, notches or accepting grooves or distorted surfaces which engage pin 240.

The front blade 218 may comprise different shapes and profiles. For example, the front blade 218 may comprise a curvilinear shape, a rectilinear shape, a jagged shape, etc. Further, the front blade 218 may include notches or serrated edges. The same would also apply to blade set 216 where the cutting profile could be curved, straight or jagged etc., and may contain notches or serrated edges. The mechanical broadhead 201 may be assembled as a complete unit or in sections. For example, in one instance of a sectional assembly, the rear and front blades 216 and 218 may be assembled outside of the body 202. The blade subassembly 228 may then be installed by entering the front portion of body 202 receiving apertures 212 and 214. In another example, the blade assembly 228 could be installed through a single or multiple slots in the rear of body 202. In an example of being assembled as a complete unit, the blades may enter through apertures in the body, and be coupled together in the body without requiring removal or installation of a tip or stud, allowing for a tip or stud to be formed integrally with the body.

An internal component 249 may be installed in the hollowed body 202 such that when the tip 211 is fastened, the hollowed section does not get smaller in cross section, but instead tightens on the internal component 249 to create a composite section between the tip 211, internal component 249 and body 202.

Figures 7A, 7B, 7C, 7D:
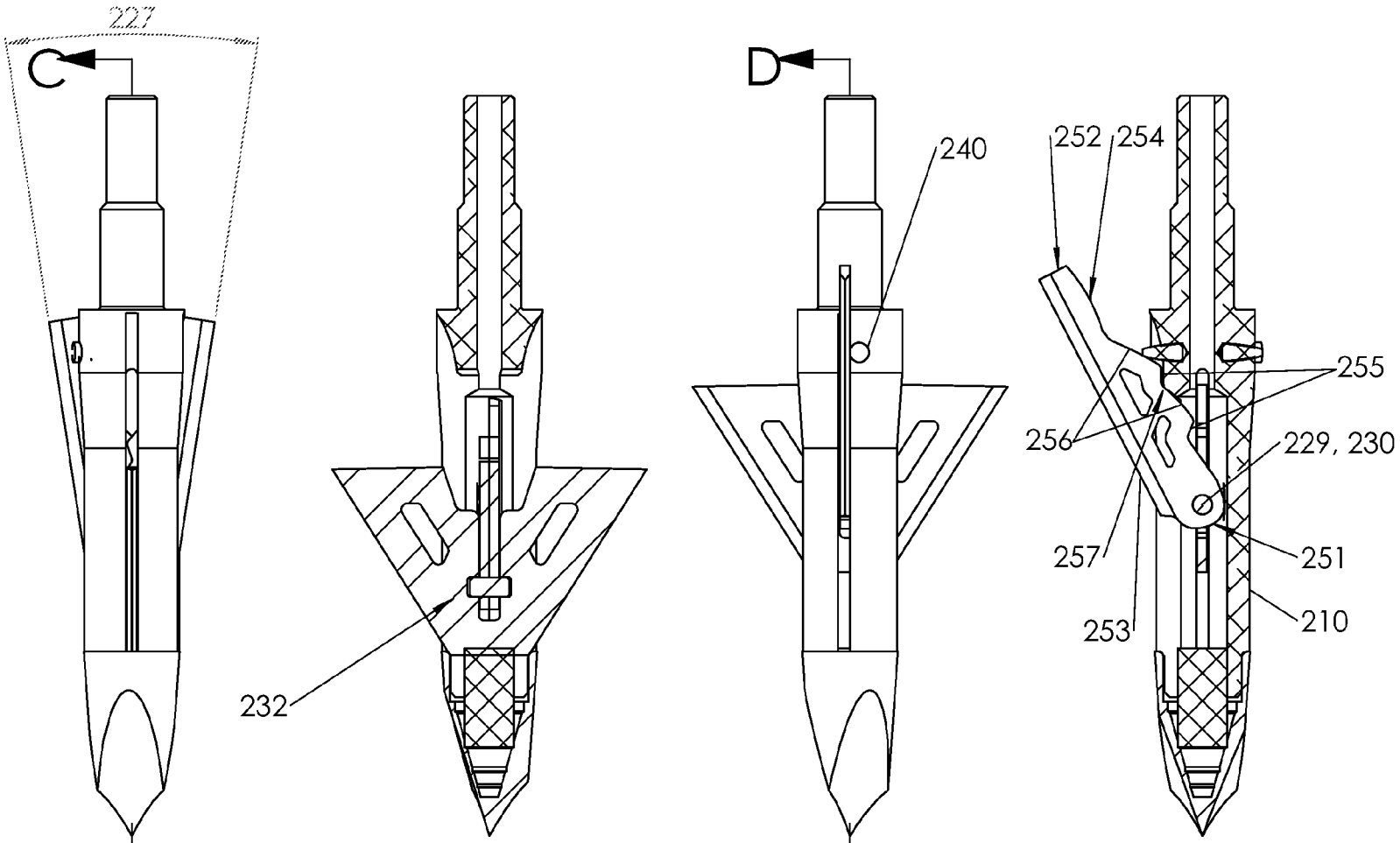
FIG. 7A illustrates a top view of the mechanical broadhead in FIG. 6A.
FIG. 7B illustrates a section view of the mechanical broadhead of FIGS. 6A and 7A taken along line C-C illustrated in FIG. 7A.
FIG. 7C illustrates a side view of the mechanical broadhead in FIG. 6A.
FIG. 7D illustrates a section view of the mechanical broadhead of FIGS. 6 and 7C taken along line D-D illustrated in FIG. 7C.

FIG. 7D shows the hinged blades 216 may include a nose 251 opposite a tail 252, and a cutting edge 253 opposite a spine 254, the cutting edge 253 and the spine 254 arranged between the nose 251 and the tail 252, and wherein the nose 251 of the first blade 216 is hingeably coupled with the nose 251 of the second blade 216. FIG. 7D illustrates a mechanism wherein the hinged rear blade 216 is ratcheted to lock in one or more intermediate positions between the stowed position 222 and the deployed position 226. The multi-locking or ratcheting positions may be accomplished by a set of angled teeth 255 arranged along at least one of the spines 254 of the blades 216. During deployment, when the fixed blade 218 comes in contact with an exterior surface (e.g., a fur, a hide, etc.) and the front blade 218 pushes the rear blades 216 back such that surface 256 of the hinged blade 216 slides against surface or pawl or pocket 257 of the body 202 and thereby slides out and locks in position 224, 226 or another intermediate position where angled teeth 255 rest against a pocket 257 arranged in the body 202 in the front aperture 212. For example, if the blade 216 has an undesirable performance or problem in the shot that would deter deploying fully to position 226, then it would deploy to position 224 and lock. Moreover, the intermediate locking positions may have any combination of stepped increments of cutting diameters ranging from 0.5 inch to 3.5 inches. For example one combination of locking positions could be when blade 216 is locked in position 226 the cutting area or blade diameter could measure 2 inches, and in position 224 about 1.25 inches.

While three position are described any number of positions are contemplated. For example, a cutting diameter stepped increment of 0.75", 1.375", and 1.75".

Further, while the ratchet mechanism is illustrated as comprising notches arranged in edges of the blades 216 and a pocket 257 arranged in the body 202 in the front aperture 212 of body 202, other ratchet mechanisms are contemplated. For example, additional pockets and/or pawls may be arranged in body 202 to provide added engagement with the teeth 255 to provide various locking positions. Further, spring loaded mechanisms may be used as a ratchet mechanism. For example, a spring loaded mechanisms as used in torque wrenches is contemplated.

Additionally, separate components may be added to allow an end user to choose the length of cut. For example a user may decide to allow the deployment to only reach one intermediate position as in 224 by method of a collar attached to the body 202, or by installing a pin or rod behind the rear fixed blade 218 to limit the amount of slideable displacement and thereby limit deployed cutting diameter.

The mechanical broadhead 201 may have ribs employed on the body 102 for strength and additional cutting edges.

Figure 10A:
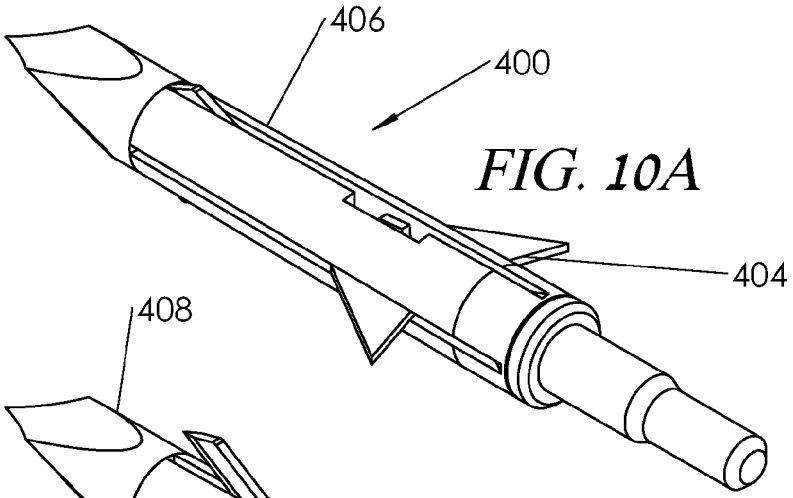
FIGS. 10A, 10B, 10C and 10D are respective views of deployment positions of a mechanical broadhead having hinged blades that are front deployed and are linked to a fixed blade.
Figure 10B:
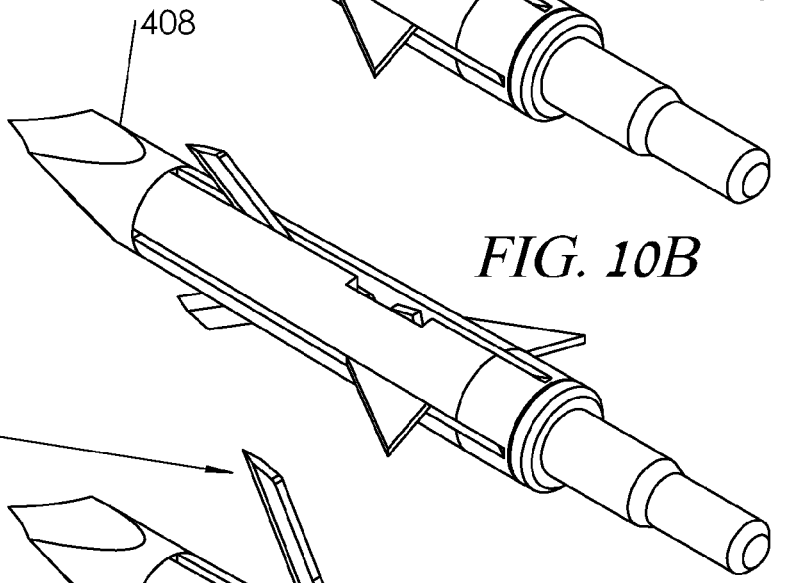
Figure 10C:
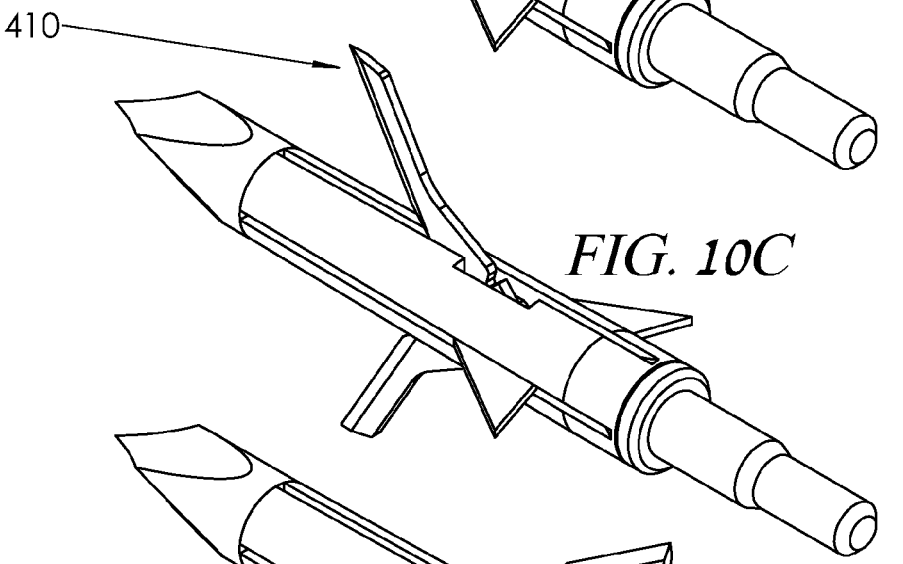
Figure 10D:
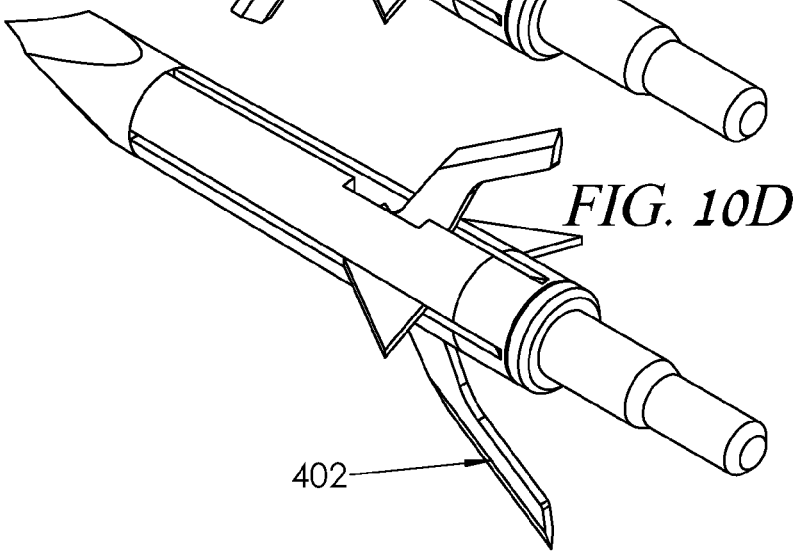

FIG. 10A illustrates another example broadhead 400. All previous descriptions of blades, tips, bodies and interfaces between components may apply to this method of construction. The key difference in the broadhead 400 from previously described is the hinged blades 402 do not slide and pivot from the rear but rather pivot from the front in order to come to a deployed position, but instead deploy with the tip in the frontal portion then rotating to the rear (front deployment). The sequence of deployment can be seen in chronological order in FIGS. 10A through 10D. A fixed blade, 404 is coupled to the hinged blades 402 in the same methods as previously described in the document. The blades may interface with body 406 in the same methods as previously described. The fixed blade 404 may slide back at impact and open the hinged blades 402. The fixed blade 404 may be in front of the hinged blades 402 or behind. A compression spring may be installed in the body 406 behind the fixed blade 404, and may thereby push the hinged blades 402 into the tip 408, and not allow them to open until the fixed blade 404 is pulled back or triggered from impact with the organism 301. The hinged blades 402 may then open fully from geometry on the front portion 410 of the blades which would act against the organism and force the blades 402 to full deployment.

All components and assemblies previously mentioned could be machined from metal, metal injection molded, extruded metal or extruded plastic, plastic injection molded, plastic injection compression molded, or composite.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A mechanical broadhead for hunting an organism comprising:

a body for penetrating the organism, the body comprising:
- a front end opposite a back end;
- a head extending between the front end and the back end;
- first and second apertures passing through the head of the body between the front end of the body and the back end of the body;

a fixed front blade comprised of a fixed front blade formed of a single unit of material, slideably disposed in the first aperture, the fixed front blade comprising a nose opposite a tail, and a pair cutting edges arranged between the nose and the tail; and a hinged rear blade assembly slideably disposed in the second aperture, the hinged rear blade assembly comprising a pair of blades, each blade of the pair of blades having a nose opposite a tail, and a cutting edge opposite a spine, the cutting edge and the spine arranged between the nose and the tail, and each of the pair of blades is pinned to the fixed front blade;

wherein each of the noses of the pair of blades is pivotably coupled with the fixed front blade between the pair of blades, and behind the nose of the fixed front blade and in front of the tail of the fixed front blade;

wherein when the fixed front blade contacts the organism, the fixed front blade slideably displaces from a first position to a second position, and displaces the hinged rear blade assembly from a stowed position where each of the pair of blades are adjacent to the body to a deployed position where each of the pair of blades are distal to the body.

2. The mechanical broadhead according to claim 1, wherein each of the noses of the pair of blades is pivotably coupled to each other via a pin, and the pin and the noses of the pair of blades are pivotably coupled in a cooperating notch arranged in the fixed front blade between the pair of blades, and behind the nose of the fixed front blade and in front of the tail of the fixed front blade.

3. The mechanical broadhead according to claim 1, wherein each of the noses of the pair of blades is pivotably coupled to a tab arranged behind the nose of the fixed front blade and in front of the tail of the fixed front blade.

4. The mechanical broadhead according to claim 1, further comprising a ratchet mechanism arranged in the head to lock the hinged rear blade in one or more intermediate positions between the stowed position and the deployed position.

5. The mechanical broadhead according to claim 4, wherein the ratchet mechanism comprises a set of angled teeth arranged along at least one of the spines of the pair of blades to engage with a pocket arranged in the second aperture.

6. A broadhead for hunting an animal comprising:

an elongated tubular body comprising:

a front end opposite a back end;

a head extending between the front end and the back end;

a plurality of slots passing through the head of the body between the front end of the body and the back end of the body; and a blade assembly slideably disposed in the plurality of slots comprising a hinged blade connected with a fixed blade, the fixed blade formed of a single unit of material, and the hinged blade including a pair of blades, each blade of the pair of blades having a nose opposite a tail and a cutting edge opposite a spine, the cutting edge and the spine arranged between the nose and the tail, and each of the pair of blades is pinned to the fixed blade;

wherein each of the noses of the pair of blades is pivotably coupled with the fixed blade between the pair of blades, and behind the nose of the fixed blade and in front of the tail of the fixed blade;

wherein when the blade assembly penetrates the animal, the fixed blade slideably displaces from a first position to a second position, and simultaneously displaces the hinged blade from a stowed position where the hinged blade is adjacent to the body to a deployed position where the hinged blade is distal to the body.

7. The broadhead according to claim 6, wherein the hinged blade is ratcheted to lock the hinged blade in one of the one or more intermediate positions between the stowed position and the deployed position.

8. The broadhead according to claim 6, further comprising a protrusion arranged in at least one of the plurality of slots to interfere with and retain the hinged blade in the stowed position when the fixed blade is in the first position, and to release the hinged blade when the fixed blade is slideably displaced from the first position to the second position, or to an intermediate position between the first position and the second position.

9. The broadhead according to claim 8, wherein the protrusion is mechanically fastened to the head of the elongated tubular body adjacent to the at least one of the plurality of slots.

10. The broadhead according to claim 9, wherein the mechanically fastened protrusion comprises a pin fixed in an aperture arranged in the head of the elongated tubular body adjacent to the at least one of the plurality of slots.

11. The broadhead according to claim 10, wherein the pin comprises plastic, wood, metal, or composite.

12. The mechanical broadhead according to claim 8, wherein the protrusion is formed integral with the head of the elongated tubular body adjacent to the at least one of the plurality of slots.

13. The broadhead according to claim 6, further comprising a tip fixed to the front end of the body and a stud fixed to the back end of the body.

14. The broadhead according to claim 13, wherein the stud and the body are formed of a single unit, and the tip is mechanically fastened to the front end of the body.

15. A mechanical broadhead for hunting an animal comprising:

a hinged blade assembly slideably disposed in a body of the mechanical broadhead for penetrating the animal, the hinged blade assembly comprising:

a fixed blade formed of a single unit of material comprising a nose opposite a tail, and a cutting edge arranged between the nose and the tail;

first and second blades, the first and second blades each having a nose opposite a tail, and a cutting edge opposite a spine, the cutting edge and the spine arranged between the nose and the tail of the first and second blades, and wherein the noses of the first and second blades are pivotably coupled with the fixed blade;

wherein the noses of the first and second blades are pivotably coupled via a pin defining a hinge, and the hinge of the first and second blades is pivotably coupled to the fixed front blade behind the nose of the fixed front blade and in front of the tail of the fixed front blade.

16. The mechanical broadhead according to claim 15, wherein the first and second blades include a ratchet to lock the first and second blades in one or more intermediate positions between a stowed position where the first and second blades are adjacent to the body and a deployed position where the first and second blades are distal to the body.

17. The mechanical broadhead according to claim 16, wherein the ratchet comprises a set of angled teeth arranged in at least one of the spines of the first and second blades configured to engage with a pocket arranged in the body.

18. The mechanical broadhead according to claim 15, wherein the hinge of the first and second blades are pivotably coupled in a cooperating notch arranged in the fixed front blade behind the nose of the fixed front blade and in front of the tail of the fixed front blade.

* * * * *